US010017721B2

(12) United States Patent
Krubasik et al.

(10) Patent No.: US 10,017,721 B2
(45) Date of Patent: Jul. 10, 2018

(54) DETERGENT COMPOSITION

(71) Applicant: RECKITT BENCKISER FINISH B.V., Hoofddorp (NL)

(72) Inventors: Lucia Krubasik, Ludwigshafen (DE); Judith Preuschen, Ludwigshafen (DE); Andrea Stein, Ludwigshafen (DE)

(73) Assignee: RECKITT BENCKISER FINISH B.V., hoofddorp (NL)

( * ) Notice: Subject to any disclaimer, the term of this patent is extended or adjusted under 35 U.S.C. 154(b) by 0 days.

(21) Appl. No.: 15/394,442

(22) Filed: Dec. 29, 2016

(65) Prior Publication Data

US 2017/0107459 A1 Apr. 20, 2017

Related U.S. Application Data

(62) Division of application No. 14/008,530, filed as application No. PCT/GB2012/050721 on Mar. 30, 2012, now Pat. No. 9,540,591.

(30) Foreign Application Priority Data

Mar. 31, 2011 (GB) ..... 1105397.2

(51) Int. Cl.

| | |
|---|---|
| ***C11D 1/28*** | (2006.01) |
| ***C11D 1/83*** | (2006.01) |
| ***C11D 3/386*** | (2006.01) |
| ***B08B 3/04*** | (2006.01) |
| ***C11D 11/00*** | (2006.01) |
| ***C11D 1/12*** | (2006.01) |
| ***C11D 1/66*** | (2006.01) |

(52) U.S. Cl.

CPC ..... *C11D 11/0023* (2013.01); *C11D 1/12* (2013.01); *C11D 1/28* (2013.01); *C11D 1/66* (2013.01)

(58) Field of Classification Search

CPC .. C11D 1/28; C11D 1/83; C11D 3/386; B08B 3/04

See application file for complete search history.

(56) References Cited

U.S. PATENT DOCUMENTS

| | | | |
|---|---|---|---|
| 3,764,542 | A | 10/1973 | Natali et al. |
| 4,233,171 | A | 11/1980 | McLaughlin et al. |
| 5,358,655 | A | 10/1994 | Kruse et al. |
| 6,191,088 | B1 | 2/2001 | Binstock et al. |
| 7,935,668 | B2 | 5/2011 | Enkel et al. |
| 2007/0135323 | A1 | 6/2007 | Wiedemann et al. |
| 2010/0048447 | A1 | 2/2010 | Hatzelt et al. |

FOREIGN PATENT DOCUMENTS

| | | | | | |
|---|---|---|---|---|---|
| DE | 266805 | A1 | | 4/1989 | |
| DE | 10237008 | | * | 3/2004 | ..... A61K 7/50 |
| DE | 10237008 | A1 | | 3/2004 | |
| EP | 0171007 | A2 | | 2/1986 | |
| EP | 0318279 | A2 | | 5/1989 | |
| GB | 751273 | A | | 6/1956 | |
| JP | 2001064698 | A | | 3/2001 | |
| JP | 2006096829 | A | | 4/2006 | |
| WO | 9426859 | A1 | | 11/1994 | |
| WO | 9426860 | A1 | | 11/1994 | |
| WO | 9501416 | A1 | | 1/1995 | |
| WO | 9826758 | A2 | | 6/1998 | |
| WO | WO 98/26758 | | * | 6/1998 | ..... A61K 7/50 |

OTHER PUBLICATIONS

International Search Report dated Sep. 26, 2012 for priority application PCT/GB2012/050721.

* cited by examiner

*Primary Examiner* — Brian P Mruk
(74) *Attorney, Agent, or Firm* — Troutman Sanders LLP; Ryan Schneider; Chris Davis

(57) ABSTRACT

The invention relates to a method of using an automatic dishwashing detergent composition that is formulated to provide effective cleaning at low temperatures.

20 Claims, No Drawings

DETERGENT COMPOSITION

CROSS-REFERENCE TO RELATED APPLICATIONS

This application is a divisional application of, and claims priority to, U.S. patent application Ser. No. 14/008,530, filed 25 Oct. 2013, and issuing on 10 Jan. 2017 as U.S. Pat. No. 9,540,591, which is a US National Stage of International Application No. PCT/GB2012/050721, filed 30 Mar. 2012, which claims the benefit of GB 1105397.2, filed 31 Mar. 2011, all herein fully incorporated by reference.

BACKGROUND OF THE INVENTION

1. Field of the Invention

The invention relates to automatic dishwashing detergent compositions. In particular, the invention relates to low temperature dishwashing detergent compositions.

2. Background

The current trend in automatic dishwashing is to improve the environmental impact of the cleaning process. This has manifested itself mainly in three ways, firstly by the use of less water during the cleaning cycle, secondly by the reduction of the use of phosphates in the detergent compositions and thirdly by the reduction in energy consumption of the machines during the cleaning cycle.

The latter trend has lead to new machines that are increasingly offering wash programs using lower cleaning and drying temperature settings than have historically been on offer. Where previously, ten years ago, an economy wash may have been carried out at 55° C., now there are commercially available dishwashing machines that offer programs at temperatures as low 45° C. and even 40° C.

This drop in wash temperature raises a number of different technical challenges to the manufacturers of detergent formulations to maintain cleaning performance at these lower temperatures.

One of the issues is the cleaning of fats from soiled tableware. Currently animal and vegetable fats are melting in machines and wash programs above 50° C. This makes them relatively simple to emulsify and remove from the surface of tableware.

However at lower temperatures, around 40-45° C., it becomes increasingly difficult to remove such fats as this temperature may be below their melting point. This is a particular problem with certain animal fats and hydrogenated plant fats, triglycerides and fatty acids.

This can lead to unpleasant fatty deposits being left either on the tableware or on the internal surfaces of the dishwasher itself at the end of cleaning cycles when current detergent formulations are used.

It is the object of the present invention to address this problem.

BRIEF SUMMARY OF THE INVENTION

As specified in the Background Section, there is a great need in the art to identify technologies for removing fats at lower temperatures and use this understanding to develop novel compositions and methods of using such compositions. The present invention satisfies this and other needs.

In one aspect, the invention provides a method of automatic dishwashing, comprising introducing an automatic dishwashing detergent composition into an automatic dishwasher and operating the dishwasher, wherein the automatic dishwashing detergent composition comprises at least one low temperature emulsifying surfactant of the formula:

$$R—CO—NMe\text{-}CH_2—CH_2—SO_3—X$$

wherein R is a saturated or unsaturated, straight or branched, alkyl chain of between 6 and 18 carbons; and wherein X is a positively charged counter ion.

In some embodiments, the at least one low temperature emulsifying surfactant is present between 0.0001 and 1% by weight of the automatic dishwashing detergent composition.

In other embodiments, the at least one low temperature emulsifying surfactant is present between 0.005 and 1% by weight of the automatic dishwashing detergent composition.

In still other embodiments, the automatic dishwashing detergent composition further comprises at least one low temperature emulsifying surfactant which is a nonionic surfactant.

In one embodiment, the at least one low temperature emulsifying surfactant is sodium methyl cocoyl taurate.

In some embodiments, the temperature at which cleaning occurs inside the dishwasher using the automatic dishwashing detergent composition is less than or equal to 50° C.

In other embodiments, the temperature at which cleaning occurs inside the dishwasher using the automatic dishwashing detergent composition is less than or equal to 45° C.

In yet other embodiments, the automatic dishwashing detergent composition comprises a total amount of surfactants of up to 15% by weight of the automatic dishwashing detergent composition.

In some embodiments, the automatic dishwashing detergent composition comprises a total amount of builder of at least 15% by weight of the automatic dishwashing detergent composition.

In other embodiments, the automatic dishwashing detergent composition further comprises at least one enzyme present between 0.01 to 5% by weight of the automatic dishwashing detergent composition.

In further embodiments, the automatic dishwashing detergent composition further comprises an oxidation catalyst present between 0.005 and 1% by weight of the automatic dishwashing detergent composition.

In some embodiments, the automatic dishwashing detergent composition is in the form selected from the group consisting of a compressed tablet, powder, liquid, PVOH gel pack and rigid PVOH capsule.

In another aspect, the invention provides a method of automatic dishwashing, comprising introducing an automatic dishwashing detergent composition into an automatic dishwasher and operating the dishwasher at a temperature of 50° C. or less, wherein the automatic dishwashing detergent composition comprises at least one low temperature emulsifying surfactant of the formula:

$$R—CO—NMe\text{-}CH_2—CH_2—SO_3—X$$

wherein R is a saturated or unsaturated, straight or branched, alkyl chain of between 6 and 18 carbons; wherein X is a positively charged counter ion; and wherein the at least one low temperature emulsifying surfactant is present between 0.0001 and 1% by weight of the automatic dishwashing detergent composition.

In some embodiments, the at least one low temperature emulsifying surfactant is present between 0.005 and 1% by weight of the automatic dishwashing detergent composition.

In other embodiments, the automatic dishwashing detergent composition comprises at least one additional low temperature emulsifying surfactant which is an anionic surfactant.

In further embodiments, the automatic dishwashing detergent composition comprises at least one additional low temperature emulsifying surfactant which is a nonionic surfactant.

In one embodiment, the at least one low temperature emulsifying surfactant is sodium methyl cocoyl taurate.

In another aspect, the invention provides a method of automatic dishwashing, comprising introducing an automatic dishwashing detergent composition into an automatic dishwasher and operating the dishwasher at a temperature of 45° C. or less, wherein the automatic dishwashing detergent composition comprises sodium methyl cocoyl taurate.

In some embodiments, the sodium methyl cocoyl taurate is present between 0.0001 and 1% by weight of the automatic dishwashing detergent composition.

In other embodiments, the sodium methyl cocoyl taurate is present between 0.005 and 1% by weight of the automatic dishwashing detergent composition.

In a related aspect of the present invention, there is provided an automatic dishwashing detergent composition that is suitable for low temperature cleaning wherein the detergent comprises at least one surfactant which is a low temperature emulsifying surfactant.

In a further aspect of the present invention, the low temperature emulsifying surfactant is selected from the class of taurate surfactants.

In a further aspect of the present invention the anionic surfactant is selected from the following formula:

$$R—CO—NMe-CH_2—CH_2—SO_3—X$$

wherein R is a saturated or unsaturated, straight or branched, alkyl chain of between 6 and 18 carbons and wherein in X is a positively charged counter ion, preferably Li, Na or K.

In a further aspect of the present invention, the anionic surfactant is sodium methyl cocoyl taurate.

In a further aspect of the present invention, the low temperature emulsifying surfactant is a non ionic surfactant, and in particular Plurafac LF 223 (C13-EO-butylene oxide).

These and other objects, features and advantages of the present invention will become more apparent upon reading the following specification in conjunction with the accompanying description and claims.

DETAILED DESCRIPTION OF THE INVENTION

As specified in the Background Section, there is a great need in the art to identify technologies for removing fats at lower temperatures and use this understanding to develop novel compositions and methods of using such compositions. The present invention satisfies this and other needs.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named. In other words, the terms "a," "an," and "the" do not denote a limitation of quantity, but rather denote the presence of "at least one" of the referenced item.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value. Further, the term "about" means within an acceptable error range for the particular value as determined by one of ordinary skill in the art, which will depend in part on how the value is measured or determined, i.e., the limitations of the measurement system. For example, "about" can mean within an acceptable standard deviation, per the practice in the art. Alternatively, "about" can mean a range of up to ±20%, preferably up to ±10%, more preferably up to ±5%, and more preferably still up to ±1% of a given value. Alternatively, particularly with respect to biological systems or processes, the term can mean within an order of magnitude, preferably within 2-fold, of a value. Where particular values are described in the application and claims, unless otherwise stated, the term "about" is implicit and in this context means within an acceptable error range for the particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

Throughout this description, various components may be identified having specific values or parameters, however, these items are provided as exemplary embodiments. Indeed, the exemplary embodiments do not limit the various aspects and concepts of the present invention as many comparable parameters, sizes, ranges, and/or values may be implemented. The terms "first," "second," and the like, "primary," "secondary," and the like, do not denote any order, quantity, or importance, but rather are used to distinguish one element from another.

It is noted that terms like "specifically," "preferably," "typically," "generally," and "often" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention. It is also noted that terms like "substantially" and "about" are utilized herein to represent the inherent degree of uncertainty that may be attributed to any quantitative comparison, value, measurement, or other representation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "50 mm" is intended to mean "about 50 mm."

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention, for example. Any dimensions listed in the various drawings are for illustrative purposes only and are not intended to be limiting. Other dimensions and proportions are contemplated and intended to be included within the scope of the invention.

Embodiments of the Invention

The applicants have surprisingly found that small amounts of very particular surfactants can massively improve the performance in terms of fat removal of automatic dishwashing (ADW) detergents at low temperature and further, have no detrimental effect on the wash performance generally. These particular low temperature emulsifying surfactants can be either non-ionic or anionic surfactants.

This is surprising because anionic surfactants are not generally used in ADW formulations. This is because this class of surfactants usually causes severe foaming problems in automatic dishwashers. The surfactants that are normally used are good wetting agents that lower the surface tension of porcelain, glass, stainless steel, silver and plastic surfaces when washed with the wash liquor. Anionic surfactants are typically good emulsifying agents, thus capable of forming micelles and vesicles in solution. Those formed aggregates can carry hydrophobic parts such a greasy soil in the wash liquor. Anionic surfactants work best at room temperature and slightly elevated temperatures and are used currently in hand dish detergents and cosmetic applications to emulsify fat in lotions.

Foam generation causes the automatic dishwashing machines to cease working effectively. This is due to the resistance provided by the foam to the rotating wash liquor spray jets. The foam build up prevents the spray blades from rotating and thus prevents the wash liquor from reaching all surfaces of the tableware.

In serious cases foaming can also causes leakages of the wash liquor from the machine.

A particularly preferred class of anionic surfactants for use in the present invention are the taurate class.

A particularly preferred surfactant may be selected from the following formula:

$$R—CO—NMe-CH_2—CH_2—SO_3—X$$

wherein R is a saturated or unsaturated, straight or branched, alkyl chain of between 6 and 18 carbons and wherein in X is a positively charged counter ion. X is preferably a metal counter ion, for example Li, Na or K.

A particularly preferred anionic surfactant for the purposes of the present invention is sodium methyl cocoyl taurate. The IUPAC chemical name is sodium 2-[methyl-[(Z)-octadec-9-enoyl]amino]ethanesulfonate. A preferred source of this is Adinol CT 95™ which is supplied by Croda.

Non-ionic surfactants are generally used in ADW formulations as these have very low foam generation properties. Not all non-ionic surfactants have low temperature emulsifying properties.

A non-ionic that is a low temperature emulsifying surfactant is Plurafac LF 223TM (C13-EO-butylene oxide). This is supplied by BASF.

Small quantities of the low temperature emulsifying surfactants above are especially effective in removing fats at low temperatures.

The low temperature emulsifying surfactants may be used singly or in combination with other low temperature emulsifying surfactants.

The amount of the low temperature emulsifying surfactant in the detergent composition needed to improve the fat removing effect may be very low.

The total amount of low temperature emulsifying surfactants included in the ADW detergent compositions of the present invention may be between 0.0001% and 1% by weight, preferably between 0.0003% and 0.1% by weight and more preferably between 0.0005% and 0.05% by weight.

In a typical detergent composition for an automatic dishwasher (approximate weight of between 17 and 25 grams per dose), the total low temperature emulsifying surfactant content may be between 0.1 mg and 250 mg, preferably between 1 mg and 100 mg, more preferably between 5 mg and 80 mg, most preferably between 10 mg and 50 mg.

The detergent composition of the present invention may be a single formulation or be composed of two or more separate formulations. For example, a multi-layer tablet. Detergent compositions are often provided as a combination of two or more separate formulations to allow for the potentially incompatible reagents (such as enzymes and bleaches) to be stored effectively.

If multiple formulations make up the composition, the low temperature emulsifying surfactant may be provided in any one of the formulations or all of them.

The detergent composition of the present invention may be effective at removing fats from tableware at wash temperatures less than or equal to 50° C., preferably less than or equal to 45° C. and most preferably less than or equal to 40° C.

By wash temperatures, this means the temperature of the wash liquor attained in the cleaning cycle. The wash temperature does not necessarily include the temperature of the drying portion of the wash cycle, although this is preferable. The drying temperature may be above the temperature of the wash temperature.

The detergent compositions of the present invention are particularly effective at removing fats from tableware that have a melting point above that of the wash temperature.

Optional Ingredients

In addition to low temperature emulsifying surfactants above, the detergent compositions of the present invention may comprise one or more of the following ingredients.

Bleaches

Any conventional bleaching compound can be used in any conventional amount, in either the composition of the invention or in any other detergent composition forming part of a multi-phase unit dose detergent composition.

There may be more than one bleaching compound in the detergent compositions of the present invention. A combination of bleaching compounds can be used.

The bleaching compound is preferably present in the relevant composition in an amount of at least 1% by weight, more preferably at least 2% by weight, more preferably at least 4% weight. Preferably it is present in the relevant composition in an amount of up to 30% weight, more preferably up to 25% weight, and most preferably up to 20% by weight.

If more than one bleaching compound is used, the total fraction of bleaching compound is preferably present in the relevant composition in an amount of at least 1% by weight, more preferably at least 2% by weight, more preferably at least 4% weight. Preferably it is present in the relevant composition in an amount of up to 30% weight, more preferably up to 25% weight, and most preferably up to 20% by weight.

In the detergent compositions of the present invention, the bleach compound normally depends on hydrogen peroxide or per-carbonate as a hydrogen peroxide source.

Most preferably, the bleach is selected from inorganic peroxy-compounds and organic peracids and the salts derived therefrom.

Examples of inorganic perhydrates include persulfates such as peroxymonopersulfate (KMPS), perborates or percarbonates. The inorganic perhydrates are normally alkali metal salts, such as lithium, sodium or potassium salts, in particular sodium salts. The inorganic perhydrates may be present in the detergent as crystalline solids without further protection. For certain perhydrates, it is however advantageous to use them as granular compositions provided with a coating which gives the granular products a longer shelf life.

The preferred percarbonate is sodium percarbonate of the formula $2Na_2CO_3.3H_2O_2$. A percarbonate, when present, is preferably used in a coated form to increase its stability.

Organic peracids include all organic peracids traditionally used as bleaches, including, for example, perbenzoic acid and peroxycarboxylic acids such as mono- or diperoxyphthalic acid, 2-octyldiperoxysuccinic acid, diperoxydodecanedicarboxylic acid, diperoxy-azelaic acid and imidoperoxycarboxylic acid and, optionally, the salts thereof. Especially preferred is phthalimidoperhexanoic acid (PAP).

The pH of the detergent composition may be between 6 and 14, preferably between 8 and 12 and more preferably between 10 and 11.

Builders

The composition may further comprise one or more builder compounds. These may be selected, for example, from the group comprising STPP, sodium citrate, sodium iminodisuccinate, sodium hydroxyiminodisuccinate, MGDA, and glutamic diacetic acid sodium salt or combinations thereof. However, the invention is not limited to these builders.

Preferably, the total builder quantity in the detergent composition comprises from 5% to 95% by weight, preferably from 15% to 75% by weight, preferably from 25% to 65% by weight, most preferably from 30% to 60% by weight of the detergent composition.

Oxidation Catalysts

The compositions of the invention may also include oxidation catalysts.

Some non limiting examples of other oxidation catalysts that may be used in the compositions of the present invention include manganese oxalate, manganese-acetate, manganese-collagen, cobalt-amine catalysts and the Mn-TACN catalyst. The oxidation catalysts may comprise other metal compounds, such as iron or cobalt complexes.

The skilled person will be aware of other oxidation catalysts that may be successfully combined with the detergent compositions of the present invention.

The oxidation catalysts may comprised between 0.005% and 1% by weight of the detergent formulation, preferably between 0.05% and 0.5% by weight, most preferably between 0.1% and 0.3% by weight.

Surfactants

In addition to the low temperature emulsifying surfactants above, the detergent compositions of the present invention may comprise further surfactants. These are usually non-ionic surfactants.

Non-ionic surfactants are preferred for automatic dishwashing (ADW) detergents since they are defined as low foaming surfactants. The standard non-ionic surfactant structure is based on a fatty alcohol with a carbon $C_8$ to $C_{20}$ chain, wherein the fatty alcohol has been ethoxylated or propoxylated. The degree of ethoxylation is described by the number of ethylene oxide units (EO), and the degree of propoxylation is described by the number of propylene oxide units (PO).

The length of the fatty alcohol and the degree of ethoxylation and/or propxylation determines if the surfactant structure has a melting point below room temperature or in other words if is a liquid or a solid at room temperature.

Surfactants may also comprise butylene oxide units (BO) as a result of butoxylation of the fatty alcohol. Preferably, this will be a mix with PO and EO units. The surfactant chain can be terminated with a butyl (Bu) moiety.

Preferred solid non-ionic surfactants are ethoxylated non-ionic surfactants prepared by the reaction of a mono-hydroxy alkanol or alkylphenol with 6 to 20 carbon atoms. Preferably the surfactants have at least 12 moles, particularly preferred at least 16 moles, and still more preferred at least 20 moles, such as at least 25 moles of ethylene oxide per mole of alcohol or alkylphenol.

Particularly preferred solid non-ionic surfactants are the non-ionics from a linear chain fatty alcohol with 16-20 carbon atoms and at least 12 moles, particularly preferred at least 16 and still more preferred at least 20 moles, of ethylene oxide per mole of alcohol.

The non-ionic surfactants additionally may comprise propylene oxide units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols or alkylphenols which additionally comprise polyoxyethylene-polyoxypropylene block copolymer units may be used. The alcohol or alkylphenol portion of such surfactants constitutes more than 30%, preferably more than 50%, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane.

Another preferred class of non-ionic surfactant can be described by the formula:

$$R_1O[CH_2CH(CH_3)O]_x\,[CH_2CH_2O]_y\,[CH_2CH(OH)R_2]$$

where $R_1$ represents a linear or branched chain aliphatic hydrocarbon group with 4-18 carbon atoms or mixtures thereof, $R_2$ represents a linear or branched chain aliphatic hydrocarbon rest with 2-26 carbon atoms or mixtures thereof, x is a value between 0.5 and 1.5, and y is a value of at least 15.

Another group of preferred non-ionic surfactants are the end-capped polyoxyalkylated non-ionics of formula:

$$R_1O[CH_2CH(R_3)O]_x[CH_2]_kCH(OH)[CH_2]_jOR_2$$

where $R_1$ and $R_2$ represent linear or branched chain, saturated or unsaturated, aliphatic or aromatic hydrocarbon groups with 1-30 carbon atoms, $R_3$ represents a hydrogen atom or a methyl, ethyl, n-propyl, iso-propyl, n-butyl, 2-butyl or 2-methyl-2-butyl group, x is a value between 1 and 30, and k and j are values between 1 and 12, preferably between 1 and 5. When the value of x is >2, each $R_3$ in the formula above can be different. $R_1$ and $R_2$ are preferably linear or branched chain, saturated or unsaturated, aliphatic or aromatic hydrocarbon groups with 6-22 carbon atoms, where group with 8 to 18 carbon atoms are particularly preferred. For the group $R_3$=H, methyl or ethyl are particularly preferred. Particularly preferred values for x are comprised between 1 and 20, preferably between 6 and 15.

As described above, in case x>2, each $R_3$ in the formula can be different. For instance, when x=3, the group $R_3$ could be chosen to build ethylene oxide ($R_3$=H) or propylene oxide ($R_3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R_1O[CH_2CH(R_3)O]_xCH_2CH(OH)CH_2OR_2$$

The use of mixtures of different nonionic surfactants is suitable in the context of the present invention, for instance, mixtures of alkoxylated alcohols and hydroxy group containing alkoxylated alcohols.

Other suitable surfactants are disclosed in WO 95/01416, to the contents of which express reference is hereby made.

In a particularly preferred embodiment of the present invention, the composition according to the first aspect of the present invention is one wherein the liquid non-ionic surfactant has the general formula:

$$R_1\text{-}[EO]_n\text{—}[PO]_m\text{—}[BO]_p\text{-}Bu_q$$

wherein: $R_1$ is an alkyl group of between $C_8$ and $C_{20}$; EO is ethylene oxide; PO is propylene oxide; BO is butylene oxide; Bu is butylene; n and m are integers from 1 to 15; p is an integer from 0 to 15; and q is 0 or 1.

Examples of especially preferred nonionic surfactants are the Lutensol™ and Pluronic™ range from BASF, Dehypon™ series from Cognis/BASF and Genapol™ series from Clariant.

The total amount of surfactants typically included in the detergent compositions is in amounts of up to 15% by weight, preferably of from 0.5% to 10% by weight and most preferably from 1% to 5% by weight.

Preferably non-ionic surfactants are present in the compositions of the invention in an amount of from 0.1% to 10% by weight, more preferably 0.25% to 7% by weight and most preferably 0.5% to 5% by weight.

Bleach Activators

Generally, the use of a bleach activator in a detergent composition can lead to a significant reduction in the effective washing temperature. Compositions of the present invention may also comprise a bleach activator.

If desired therefore, the detergent compositions may comprise one or more additional bleach activators depending upon the nature of the bleaching compound.

Any suitable bleach activator or combination of bleach activators may be included. A non-limiting example of a common bleach activator is tetraacetylethylenediamine (TAED).

Conventional amounts of the bleach activators may be used, e.g., in amounts of from 0.5% to 30% by weight, more preferred of from 1% to 25% by weight and most preferred of from 2% to 20% by weight of the detergent composition.

Enzymes

The composition may comprise one or more enzymes. Desirably the enzyme is present in the compositions in an amount of from 0.01% to 5% by weight especially 0.01% to 4% by weight, for each type of enzyme when added as a commercial preparation. As they are not 100% active preparations this represents an equivalent amount of 0.005% to 1% by weight of pure enzyme, preferably 0.01% to 0.75% by weight, especially 0.01% to 0.5% by weight of each enzyme used in the compositions. The total amount of enzyme in the detergent composition is preferably in the range of from 0.01% to 6% weight percent, especially 0.01% to 3% by weight, which represents an equivalent amount of 0.01% to 2% by weight of pure enzyme, preferably 0.02% to 1.5% by weight, especially 0.02% to 1% by weight of the total active enzyme used in the compositions.

Any type of enzyme conventionally used in detergent compositions may be used according to the present invention. It is preferred that the enzyme is selected from proteases, lipases, amylases, cellulases, pectinases, laccases, catalases and all oxidases, with proteases, pectinases and amylases, (especially proteases) being most preferred. It is most preferred that protease and/or pectinases and/or amylase enzymes may be included in the compositions according to the invention; such enzymes are especially effective for example in dishwashing detergent compositions. Any suitable species of these enzymes may be used as desired.

Anti Corrosion Agents

Preferred silver/copper anti-corrosion agents are benzotriazole (BTA) or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

It is known to include a source of multivalent ions in detergent compositions, and in particular in automatic dishwashing compositions, for anti-corrosion benefits. For example, multivalent ions and especially zinc, bismuth and/or manganese ions have been included for their ability to inhibit such corrosion. Organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$ and $Ce(NO_3)_3$. Any suitable source of multivalent ions may be used, with the source preferably being chosen from sulphates, carbonates, acetates, gluconates and metal-protein compounds. Zinc salts are specially preferred glass corrosion inhibitors.

Any conventional amount of the anti-corrosion agents may be included in the compositions of the invention. However, it is preferred that they are present in an total amount of from 0.01% to 5% by weight, preferably 0.05% to 3% by weight, more preferably 0.1% to 2.5% by weight, such as 0.1% to 1% by weight based on the total weight of the composition. If more than one anti-corrosion agent is used, the individual amounts may be within the preceding amounts given but the preferred total amounts still apply.

Format of the Composition

The detergent composition may take any form known in the art. Possible forms include, e.g., tablets, powders, gels, pastes and liquids. The detergent compositions may also comprise a mixture of two or more forms. For example, the composition may comprise a gel component and a free powder component.

Tablets may be homogeneous or composed of multi-layers. If the tablets are multi-layered, then different layers may comprise different parts of the detergent composition. This may be done to increase stability or increase performance, or both.

The detergent compositions may be housed in PVOH rigid capsules or film blisters. These PVOH capsules or blisters may have a single compartment or may be multi-compartment.

Multi-compartment blisters or capsules may have different portions of the composition in each compartment, or the same composition in each compartment. The distinct regions/or compartments may contain any proportion of the total amount of ingredients as desired.

The PVOH capsules or film blisters may be filled with tablets, powders, gels, pastes or liquids, or combinations of these.

The invention is further demonstrated by the following non-limiting examples. Further examples within the scope of the invention will be apparent to the person skilled in the art.

EXAMPLES

The present invention is also described and demonstrated by way of the following examples. However, the use of these and other examples anywhere in the specification is illustrative only and in no way limits the scope and meaning of the invention or of any exemplified term. Likewise, the invention is not limited to any particular preferred embodiments described here. Indeed, many modifications and variations of the invention may be apparent to those skilled in the art upon reading this specification, and such variations can be made without departing from the invention in spirit or in scope. The invention is therefore to be limited only by the terms of the appended claims along with the full scope of equivalents to which those claims are entitled.

The following two ADW compositions were prepared to demonstrate the invention.

TABLE 1

| Ingredients | Formulation A | Formulation B (Control) | Formulation C |
|---|---|---|---|
| Sodium Tri-polyphosphate | 53.0 | 53.0 | 53.0 |
| Adinol CT 95 ™ | 0.005 | 0.0 | 0.0 |
| Plurafac LF 223 ™ | 0.0 | 0.0 | 0.02 |
| Sodium carbonate | 14.995 | 15.0 | 14.98 |
| Sodium percarbonate | 15.0 | 15.0 | 15.0 |
| Oxidation catalyst | 0.2 | 0.2 | 0.2 |
| TAED | 3.0 | 3.0 | 3.0 |
| Protease | 1.0 | 1.0 | 1.0 |
| Amylase | 0.5 | 0.5 | 0.5 |
| $C_{16-18}$ $EO_{25}$ | 2.0 | 2.0 | 2.0 |
| Polyethyleneglycol 1500 | 10.0 | 10.0 | 10.0 |
| Benzotriazole | 0.1 | 0.1 | 0.1 |
| Perfume | 0.1 | 0.1 | 0.1 |
| Colourant | 0.1 | 0.1 | 0.1 |
| Total | 100.0 | 100.0 | 100.0 |

The ingredients are given in a percentage by weight basis.

Test Method

In a Miele 1022 SC Dishwasher the 40° C. Schnell program is used to run the grease removal test at 40° C. with tap water (16 GH).

Formulation B (20 g) is placed in the dishwasher dispenser and washed with 7 g Chip Fat (German brand: Belasan with a melting point higher than 40° C.) which is placed on a stainless steel plate on the bottom of the dishwasher.

After running the dishwasher cycle, the metal plates are weighed and the bottom of the dishwasher is visually evaluated.

The test was repeated five times and the average results used.

The test is repeated with Formulation A (20 g) and Formulation C (20 g). The results of the tests are shown in table 2.

TABLE 2

| Product | Chip Fat recovered |
|---|---|
| Formulation B (control) | 43 mg +– 12 mg |
| Formulation A | 14 mg +– 7 mg |
| Formulation C | 19 mg +– 10 mg |

The visual inspection of the bottom with control formulation B found that that solid chip fat is not only left on the stainless steel plate, but also on the dishwasher bottom as white fat stains or on the plastic parts of the sieve system.

With formulation A and C, the chip fat on the stainless steel plate is significantly less, and also the bottom of the dishwasher shows no white fat stains.

While several possible embodiments are disclosed above, embodiments of the present invention are not so limited. These exemplary embodiments are not intended to be exhaustive or to unnecessarily limit the scope of the invention, but instead were chosen and described in order to explain the principles of the present invention so that others skilled in the art may practice the invention. Indeed, various modifications of the invention in addition to those described herein will become apparent to those skilled in the art from the foregoing description. Such modifications are intended to fall within the scope of the appended claims. Further, the terminology employed herein is used for the purpose of describing exemplary embodiments only and the terminology is not intended to be limiting since the scope of the various embodiments of the present invention will be limited only by the appended claims and equivalents thereof. The scope of the invention is therefore indicated by the following claims, rather than the foregoing description and above-discussed embodiments, and all changes that come within the meaning and range of equivalents thereof are intended to be embraced therein.

The specific configurations, choice of materials, and the size and shape of various elements can be varied according to particular design specifications or constraints requiring a device, system, or method constructed according to the principles of the invention. The specific steps in methods of making and/or using the detergent compositions can also be varied as needed. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

All patents, applications, publications, test methods, literature, and other materials cited herein are hereby incorporated by reference in their entirety as if physically present in this specification.

What is claimed is:

1. A method of automatic dishwashing, comprising introducing an automatic dishwashing detergent composition into an automatic dishwasher and operating the dishwasher, wherein the automatic dishwashing detergent composition comprises at least one low temperature emulsifying surfactant of the formula:

$$R—CO—NMe-CH_2—CH_2—SO_3—X$$

wherein R is a saturated or unsaturated, straight or branched, alkyl chain of between 6 and 18 carbons;

wherein X is a positively charged counter ion; and wherein the automatic dishwashing detergent composition further comprises at least one enzyme present between 0.01 to 5% by weight of the automatic dishwashing detergent composition.

2. The method according to claim 1, wherein the at least one low temperature emulsifying surfactant is present between 0.0001 and 1% by weight of the automatic dishwashing detergent composition.

3. The method according to claim 2, wherein the at least one low temperature emulsifying surfactant is present between 0.005 and 1% by weight of the automatic dishwashing detergent composition.

4. The method according to claim 1, wherein the automatic dishwashing detergent composition further comprises at least one low temperature emulsifying surfactant which is a nonionic surfactant.

5. The method according to claim 1, wherein the at least one low temperature emulsifying surfactant is sodium methyl cocoyl taurate.

6. The method according to claim 1, wherein the temperature at which cleaning occurs inside the dishwasher using the automatic dishwashing detergent composition is less than or equal to 50° C.

7. The method according to claim 6, wherein the temperature at which cleaning occurs inside the dishwasher using the automatic dishwashing detergent composition is less than or equal to 45° C.

8. The method according to claim 1, wherein the automatic dishwashing detergent composition comprises a total amount of surfactants of up to 15% by weight of the automatic dishwashing detergent composition.

9. The method according to claim 1, wherein the automatic dishwashing detergent composition comprises a total amount of builder of at least 15% by weight of the automatic dishwashing detergent composition.

10. The method according to claim 1, wherein the automatic dishwashing detergent composition further comprises an oxidation catalyst present between 0.005 and 1% by weight of the automatic dishwashing detergent composition.

11. The method according to claim 1, wherein the automatic dishwashing detergent composition is in the form selected from the group consisting of a compressed tablet, powder, liquid, PVOH gel pack and rigid PVOH capsule.

12. A method of automatic dishwashing, comprising introducing an automatic dishwashing detergent composition into an automatic dishwasher and operating the dishwasher at a temperature of 50° C. or less, wherein the automatic dishwashing detergent composition comprises at least one low temperature emulsifying surfactant of the formula:

$$R—CO—NMe-CH_2—CH_2—SO_3—X$$

wherein R is a saturated or unsaturated, straight or branched, alkyl chain of between 6 and 18 carbons;

wherein X is a positively charged counter ion;

wherein the at least one low temperature emulsifying surfactant is present between 0.0001 and 1% by weight of the automatic dishwashing detergent composition; and wherein the automatic dishwashing detergent composition further comprises at least one enzyme present between 0.01 to 5% by weight of the automatic dishwashing detergent composition.

13. The method according to claim 12, wherein the at least one low temperature emulsifying surfactant is present between 0.005 and 1% by weight of the automatic dishwashing detergent composition.

14. The method according to claim 12, wherein the automatic dishwashing detergent composition comprises at least one additional low temperature emulsifying surfactant which is an anionic surfactant.

15. The method according to claim 12, wherein the automatic dishwashing detergent composition comprises at least one additional low temperature emulsifying surfactant which is a nonionic surfactant.

16. The method according to claim 12, wherein the at least one low temperature emulsifying surfactant is sodium methyl cocoyl taurate.

17. The method according to claim 12, wherein the dishwasher is operated at a temperature of 45° C. or less, wherein the automatic dishwashing detergent composition comprises sodium methyl cocoyl taurate.

18. A method of automatic dishwashing, comprising introducing an automatic dishwashing detergent composition into an automatic dishwasher and operating the dishwasher, wherein the automatic dishwashing detergent composition comprises at least one low temperature emulsifying surfactant of the formula:

$$R—CO—NMe-CH_2—CH_2—SO_3—X$$

wherein R is a saturated or unsaturated, straight or branched, alkyl chain of between 6 and 18 carbons;

wherein X is a positively charged counter ion, and wherein the automatic dishwashing detergent composition further comprises an oxidation catalyst present between 0.005 and 1% by weight of the automatic dishwashing detergent composition.

19. The method according to claim 18, wherein the at least one low temperature emulsifying surfactant is present between 0.0001 and 1% by weight of the automatic dish-washing detergent composition.

20. The method according to claim 18, wherein the at least one low temperature emulsifying surfactant is sodium methyl cocoyl taurate.

* * * * *